US006988369B2

(12) United States Patent
Conete et al.

(10) Patent No.: US 6,988,369 B2
(45) Date of Patent: Jan. 24, 2006

(54) COMBUSTION CHAMBER SEALING RING, AND A COMBUSTION CHAMBER INCLUDING SUCH A RING

(75) Inventors: Eric Conete, Merignac (FR); Francis Mirambeau, St. Aubin de Medoc (FR); Georges Habarou, Le Bouscat (FR); Didier Hernandez, Quiers (FR); Christophe Pieussergues, Nangis (FR)

(73) Assignees: SNECMA Propulsion Solide, Le Haillan (FR); SNECMA Moteurs, Paris (FR)

( * ) Notice: Subject to any disclaimer, the term of this patent is extended or adjusted under 35 U.S.C. 154(b) by 180 days.

(21) Appl. No.: 10/460,736

(22) Filed: Jun. 12, 2003

(65) Prior Publication Data

US 2004/0032089 A1 Feb. 19, 2004

(30) Foreign Application Priority Data

Jun. 13, 2002 (FR) ..... 02 07291

(51) Int. Cl.
*F02C 7/20* (2006.01)

(52) U.S. Cl. ..... 60/796; 60/800; 60/798; 60/752

(58) Field of Classification Search ..... 60/796, 60/800, 757, 752, 753, 799, 798, 754, 755, 60/756, 39.37; 415/115
See application file for complete search history.

(56) References Cited

U.S. PATENT DOCUMENTS 4,458,481 A 7/1984 Ernst
4,944,151 A * 7/1990 Hovnanian ..... 60/800
5,470,198 A 11/1995 Harrogate et al. ..... 415/115
5,701,733 A * 12/1997 Lewis et al. ..... 60/796
6,131,384 A * 10/2000 Ebel ..... 60/797
6,644,034 B2 * 11/2003 Ariyoshi et al. ..... 60/800
6,647,729 B2 * 11/2003 Calvez et al. ..... 60/753
6,668,559 B2 * 12/2003 Calvez et al. ..... 60/796
6,675,585 B2 * 1/2004 Calvez et al. ..... 60/796
6,679,062 B2 * 1/2004 Conete et al. ..... 60/796
6,708,495 B2 * 3/2004 Calvez et al. ..... 60/753
6,732,532 B2 * 5/2004 Camy et al. ..... 60/796
6,775,985 B2 * 8/2004 Mitchell et al. ..... 60/772
2002/0184888 A1 12/2002 Calvez et al. ..... 60/796
2002/0184892 A1 12/2002 Calvez et al. ..... 60/796
2003/0000223 A1 * 1/2003 Conete et al. ..... 60/796
2004/0118127 A1 * 6/2004 Mitchell et al. ..... 60/796

FOREIGN PATENT DOCUMENTS

FR 2 785 664 A 5/2000
GB 2 102 897 A 2/1983

* cited by examiner

*Primary Examiner*—William H. Rodriguez
(74) *Attorney, Agent, or Firm*—Weingarten, Schurgin, Gagnebin & Lebovici LLP

(57) ABSTRACT

The present invention provides a fixing or sealing ring for maximizing cooling at the end of a combustion chamber wall. For this purpose, the ring is constituted by a sleeve which is fixed around the end of a wall of the combustion chamber by means of a plurality of orifices for receiving fasteners or by means of any other system for connecting the ring to the wall. The sleeve includes at least one recess in its face facing the wall of the combustion chamber, thereby reducing the area of the sleeve that presses against the wall, and co-operating with said wall to form an open cavity in which a cooling air stream can flow.

20 Claims, 4 Drawing Sheets

COMBUSTION CHAMBER SEALING RING, AND A COMBUSTION CHAMBER INCLUDING SUCH A RING

FIELD OF THE INVENTION

The present invention relates to the field of combustion chambers, in particular in gas turbines. More particularly, the invention relates to cooling the walls of such combustion chambers between two shrouds.

PRIOR ART

FIG. 1 is an axial section view of the downstream portion of an aeroengine gas turbine which comprises, in conventional manner, a combustion chamber 51 disposed in a combustion chamber casing 56 in annular manner around the axis 60 of the engine.

The combustion chamber 51 mainly comprises an outer wall 51*a* and an inner wall 51*b* mechanically linked respectively with the outer portion 56*a* and the inner portion 56*b* of the combustion chamber casing 56. More precisely, the outer wall 51*a* of the combustion chamber is connected to the outer portion 56*a* of the combustion chamber casing 56 by means of a plurality of flexible connection tabs 61 fixed on the outer wall 51*a* of the combustion chamber 51 by fasteners 57 of the nut-and-bolt type. Similarly, the inner wall 51*b* of the combustion chamber is connected to the inner portion 56*b* of the combustion chamber casing via a plurality of flexible tabs 62 held on the inner wall of the combustion chamber by fasteners 58, and on the inner portion of the combustion chamber casing by fasteners 59.

As shown in FIG. 1, the end of the combustion chamber is connected in leaktight manner to a high pressure nozzle 52 by a sealing device which is formed, for the outer shroud portion of the turbine, by a ring 65 in contact with a circular strip gasket 67 held in compression against the ring by a resilient holding element 69. For the inner shroud portion of the turbine, the sealing device comprises a ring 66 in contact with a circular strip gasket 68 held in compression against the ring by a resilient holder element 70. The sealing rings 65 and 66 are held respectively between the inner wall and the outer wall of the combustion chamber, and the flexible connection tabs 61 and 62 by the clamping of the fasteners 57 and 58. In other types of combustion chamber, the rings serve solely for fixing the flexible tabs. Under such circumstances, they do not have a contact flange for the circular gasket.

Typically, in an aeroengine gas turbine, the combustion chamber receives both fuel which is injected via one or more injection systems 55, and also compressed air which acts as an oxidizer. The fuel and the air are mixed together at the upstream end of the combustion chamber 54 in order to achieve combustion.

The air which is used for burning the fuel in the combustion chamber comes from a fraction of a stream of compressed air F delivered into a diffusion duct 71 by a compressor device (not shown). The remaining fraction of the compressed air stream forms a bypass stream 63, 64 which flows in the annular space 72 defined between the combustion chamber 51 and its casing 56. The bypass air stream serves to dilute the combustion gas by being reinjected into the combustion chamber, and also serves to cool the walls.

In order to withstand the high temperatures that exist inside the combustion chamber, its walls are made of a thermostructural composite material that withstands high temperatures better than a conventional metal structure. Nevertheless, even when made out of such a material, the walls of the combustion chamber still need to be cooled. For this purpose, the combustion chamber has a plurality of perforations 53 made through the inner and outer walls so that the bypass air stream 63 or 64 flowing in the annular space 72 penetrates into the combustion chamber. Consequently, the film of air flowing along the walls of the combustion chamber, and also the multiple streams penetrating via the perforations serve to reduce the temperature of the material constituting the combustion chamber in a significant manner.

Nevertheless, with the type of connection shown in FIG. 1, there inevitably remains a non-cooled zone HT at the downstream end of the combustion chamber defined by the portion where the wall of the combustion chamber makes contact with the ring. The zone where the wall of the combustion chamber is overlapped by the ring prevents any passage of a cooling film along the wall and, a fortiori, makes any perforations situated in said zone ineffective. The ends of the combustion chamber walls situated in the ring-connection zone can thus be exposed to temperatures which are significantly higher than the temperature that is acceptable by the material for the specified lifetime.

OBJECT AND BRIEF SUMMARY OF THE INVENTION

The present invention seeks to remedy the above-mentioned drawbacks and to provide a sealing ring which allows a cooling air stream to flow in the zone where the combustion chamber is connected to the casing.

These objects are achieved by a ring for fixing on the end of a combustion chamber, the ring being formed by a sleeve which is fixed around the end of a wall of the combustion chamber via a plurality of orifices for receiving fasteners, wherein the sleeve has at least one recess in its face facing the wall of the combustion chamber, thereby reducing the area of the sleeve that presses against the wall of the combustion chamber, and co-operating with said wall to form an open cavity in which a stream of cooling air can flow.

Thus, by means of the ring of the present invention, a stream of cooling air can flow to the end of the wall of the combustion chamber without any need to modify the system for connecting the combustion chamber to the casing. The wall of the combustion chamber can be provided with perforations all the way to its end. This increases the lifetime of the combustion chamber.

In a particular aspect of the invention, the ring includes an annular shoulder defining the end of the cavity formed between the ring and the wall of the combustion chamber.

Thus, the annular shoulder forms a spoiler and contributes to directing the stream of bypass air flowing in the cavity towards the wall of the combustion chamber.

In another aspect of the invention, the area of the sleeve pressing against the wall of the combustion chamber further includes contact portions formed around the orifices, said contact portions defining a plurality of recesses uniformly distributed over the face of the sleeve that faces the wall of the combustion chamber.

The ring then forms a plurality of cavities between itself and the wall of the combustion chamber, thus making it possible to calibrate more finely the flow rate of the cooling air stream.

According to a characteristic of the invention, the contact portions are of a thickness greater than the thickness of the annular shoulder so as to allow a fraction of the cooling air stream which flows in the cavity(ies) formed by the sealing ring to constitute a leakage flow. Thus, the outer shroud of the high pressure nozzle receives a portion of the cooling air stream, and the rate at which air enters into the combustion chamber can be controlled.

The ring of the invention may be made out of a thermostructural composite material or out of a metal alloy.

In a particular embodiment of the ring, it further comprises a flange extending the sleeve, the flange extending beyond the end of the combustion chamber.

The present invention also provides a combustion chamber including at least one ring as defined above, the ring being fixed to the end of one of the walls of the combustion chamber by fasteners.

Because of the structure of the ring of the present invention, the combustion chamber may have a plurality of perforations in the ring connection zone, these perforations being fed with a stream of cooling air which flows in the cavity(ies) formed between the sealing ring and the wall of the combustion chamber.

In a particular embodiment, the combustion chamber further comprises a gasket between the ring and the wall of the combustion chamber to obstruct any leakage outlet from the ring. The gasket may be held in the bottom of the open cavity or it may be placed at the end of the ring, in which case the gasket is held at the end of the ring by a piece of foil fixed with the ring on the combustion chamber.

The foil may comprise a single piece or a plurality of sectors held on the wall of the combustion chamber by the fasteners.

In another particular embodiment, each fastener includes a washer of thickness greater than that of the open cavity formed between the wall of the combustion chamber and the ring so as to allow a fraction of the cooling air stream flowing in the cavity(ies) formed beneath the ring to constitute a leakage flow.

In an embodiment of the combustion chamber, it has a step formed at the end of its wall so as to allow a fraction of the cooling air stream flowing in the cavity(ies) formed by the ring to constitute a leakage flow.

The leakage flow serves to cool the outer shroud of the high pressure nozzle, which can consequently be cooled by an additional film of cool air. In addition, the rate at which air enters into the combustion chamber can be controlled.

The present invention also provides a combustion chamber including first and second rings as described above, the first ring being fixed to the end of the outer wall of the combustion chamber and the second ring being fixed to the end of the inner wall of the combustion chamber.

Both walls of the combustion chamber are thus provided with respective rings of the invention such that the lifetime of the end of the combustion chamber is increased.

The walls of the combustion chamber may be made out of a thermostructural composite material, out of an optionally porous metal material, or indeed out of a metal-matrix composite material.

BRIEF DESCRIPTION OF THE DRAWINGS

Other characteristics and advantages of the invention appear from the following description of particular embodiments of the invention, given by way of non-limiting example, and with reference to the accompanying drawings, in which.

DETAILED DESCRIPTION OF EMBODIMENTS OF THE INVENTION

The present invention is described with reference to a ring for providing sealing between a combustion chamber and a nozzle. Nevertheless, the person skilled in the art will have no difficulty in applying the invention to a ring for connecting flexible connection tabs to the combustion chamber as described in French patent applications FR 01/07361 and FR 01/07363 in the name of the present Applicant. In general, the present invention applies to any type of ring which covers a portion of a wall of a structure that needs to be cooled by a flowing air stream.

Figure 1:
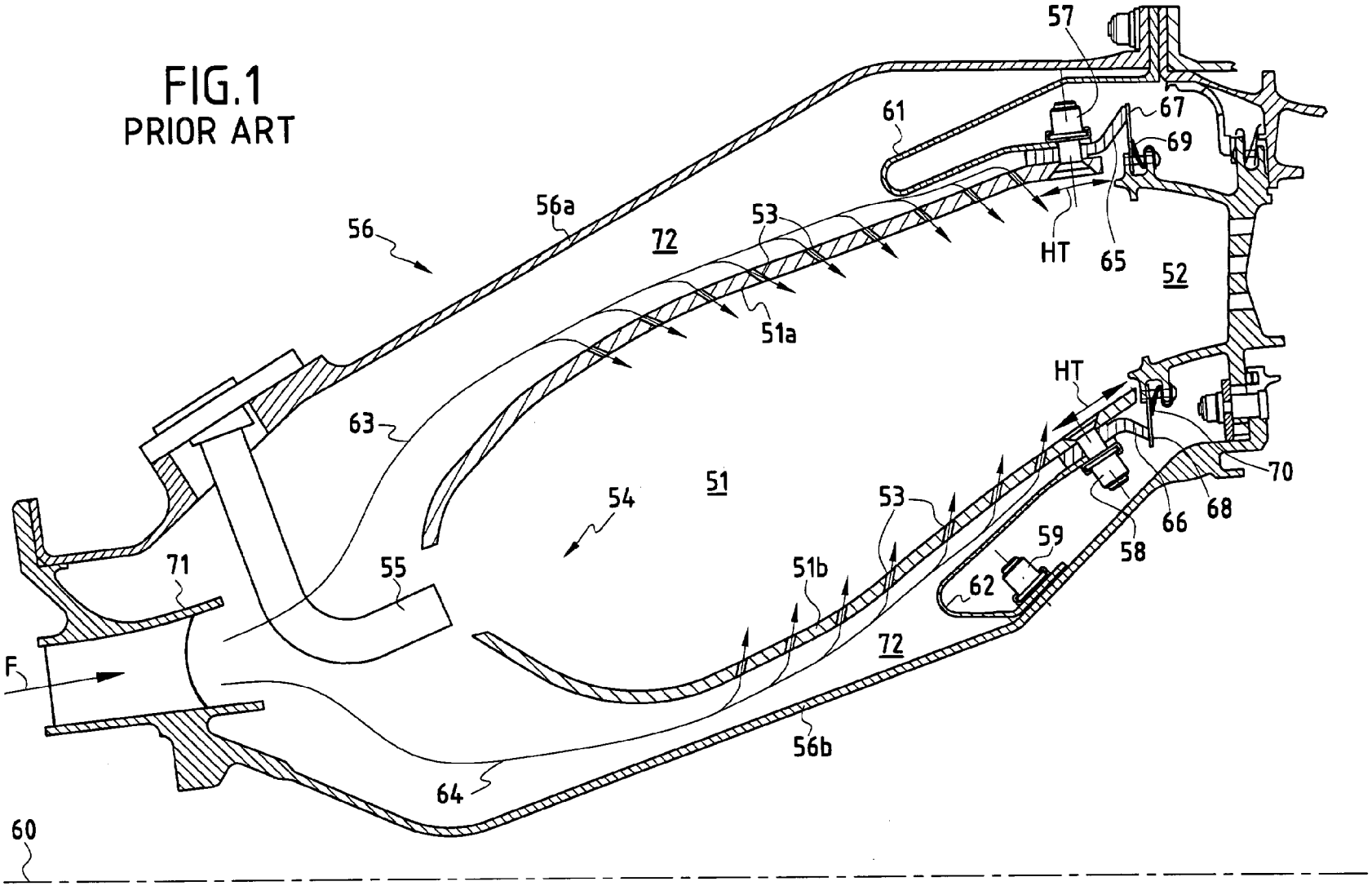
FIG.1 PRIOR ART
FIG. 1 is a half-view in axial section of a combustion chamber of a prior art aeroengine gas turbine.
Figure 2A:
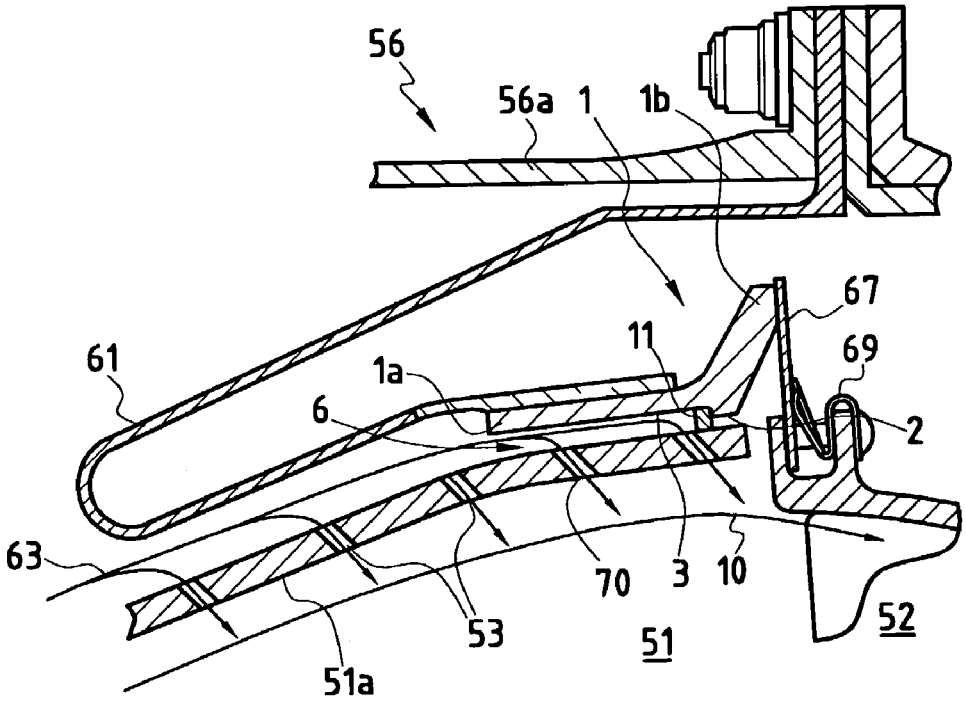
FIG. 2A is a section view of the outer wall of a combustion chamber with sealing on the inside of the ring showing ventilation beneath the ring in an embodiment of the invention.
Figure 2B:
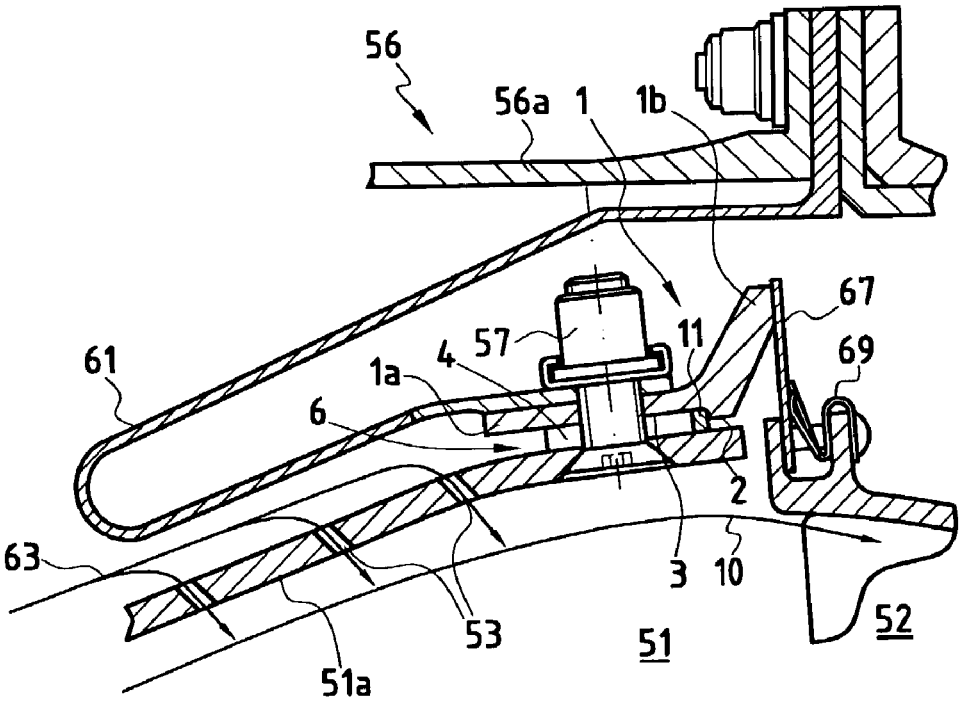
FIG. 2B is a section view of the connection portion of the outer wall of a combustion chamber with sealing inside the ring in an embodiment of the invention.
Figure 3:
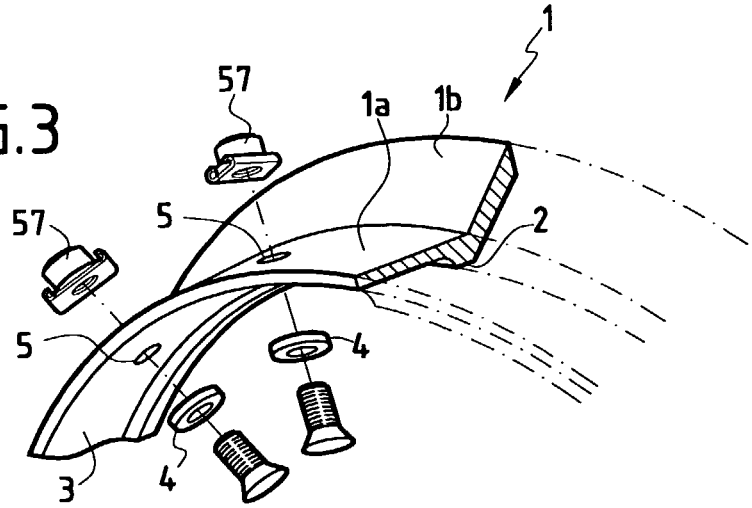
FIG. 3 is a truncated diagrammatic perspective view of a first embodiment of a sealing ring of the invention.

FIGS. 2A, 2B, and 3 show a sealing ring constituting a first embodiment of the invention. In FIG. 2, the elements of the combustion chamber and of the casing which remain unchanged are given the same reference symbols as those given in FIG. 1. In this first embodiment, the sealing ring 1 defines an annular structure comprising two portions: a sleeve 1*a* and a flange 1*b*. The sleeve 1*a* corresponds to the portion of the sealing ring which is placed around the end of the wall 51*a* of the combustion chamber 51. The sealing ring 1 is fixed to the wall 51*a* of the combustion chamber by clamping fasteners 57, each passing through a respective orifice 5 provided in the sleeve 1*a*. The ring may also be fixed by any other system for connecting the ring to the wall.

The sleeve 1*a* is extended by a collar 1*b* which extends outwards from the combustion chamber in such a manner as to cover the space between the end of the combustion chamber and the beginning of the high pressure nozzle 52 in order to make contact with a strip gasket 67 placed on the nozzle.

More particularly, the inside face of the sleeve 1*a* is machined over a large fraction in order to form a recess 3. The fraction of the inside surface of the sleeve which is not machined forms an annular shoulder 2. The sleeve 1*a* is thicker at its annular shoulder 2. In the zone for connecting the flexible tabs 61 to the wall 51*a* of the combustion chamber, as shown in FIG. 2B, a washer 4 is provided for each fastener 57. The thickness of the washer 4 is determined as a function of the depth of the recess 3 in order to ensure that the ring is positioned relative to the wall so as to guarantee that the mechanical connections can be tightened.

As shown in FIGS. 2A and 2B, the annular shoulder 2 constitutes only a small fraction of the sleeve relative to the recess 3. Thus, once the ring has been mounted on the outer wall 51*a* of the combustion chamber, the recess 3 forms a cavity 6 under the ring which, when fed with the stream of bypass or cooling air 63 serves to cool the wall all the wall to its end, as shown in FIG. 2A.

In addition, when the combustion chamber is provided not only with the perforations 53 of the kind typically formed away from the connection zone, but also with additional perorations 70 beneath the ring, a continuous cooling film 10 can be maintained all the way to the end of the wall inside the combustion chamber. The annular shoulder 2 acts as a spoiler at the end of the cavity 6 serving to force the cooling air stream 63 into the perforations 70. Furthermore, by selecting an inclined angle for the bore direction of the additional perforations 70, holes that open out almost in the end of the combustion chamber wall can be fed with the cooling stream. The cooling film 10 then advantageously constitutes a cooling film for the inner shroud of the high pressure nozzle 52.

Figure 4:
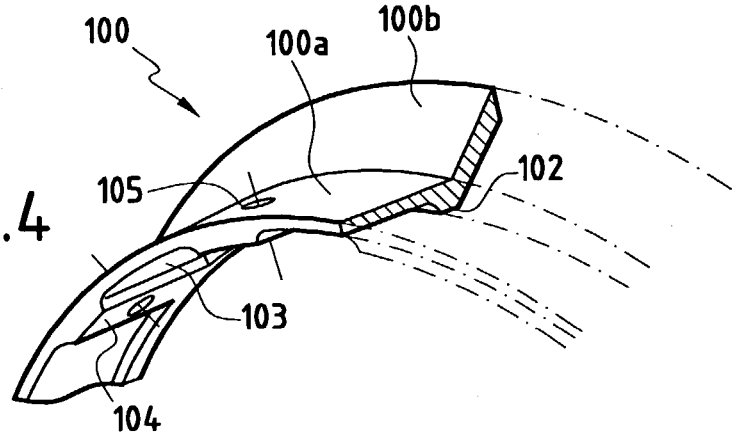
FIG. 4 is a truncated diagrammatic perspective view of a second embodiment of a sealing ring of the invention.

A second embodiment of the sealing ring of the present invention is described below with reference to FIG. 4. A sealing ring 100 is constituted by a sleeve 100*a* extended by a flange 100*b* which extends beyond the end of the wall 151*a* of the combustion chamber. The sleeve 100*a* has a plurality of recesses 103 machined in the face of the sleeve which is to be placed facing the wall 151 of the combustion chamber. Each of these recesses forms a cavity 106 to enable a cooling air stream 63 to flow to the end of the combustion chamber wall.

The recesses 103 are machined between the orifices 105 for passing the fasteners 157 so as to leave not only an annular shoulder 102, but also contact areas 104 around each orifice 105. This embodiment makes it possible to avoid using washers that are needed for positioning the ring in the first embodiment. Consequently, with this second embodiment of the sealing ring of the invention, the cooling air stream 63 can likewise flow within the cavities 106 to the end of the combustion chamber and can feed the perforations 70 made in the connection zone, while also simplifying the technology for mounting the ring.

In an embodiment of the invention, a gasket is used to obstruct leaks that exist between the ring and the wall of the combustion chamber at the outlets from the cavities, which leaks are due to manufacturing tolerances for the parts and/or to fitting the ring on the combustion chamber. For this purpose, and as shown in FIG. 2, a gasket 11, e.g. a braid, a metal wire, a channel- or omega-section gasket, or indeed a capillary tube, can be held in position and in compression between the fastener washers and the end of the cavity. When using the second embodiment of the ring 100, a groove (not shown) is provided in each contact portion 104 so as to enable the gasket 11 to be received as shown in FIG. 2.

Figure 5:
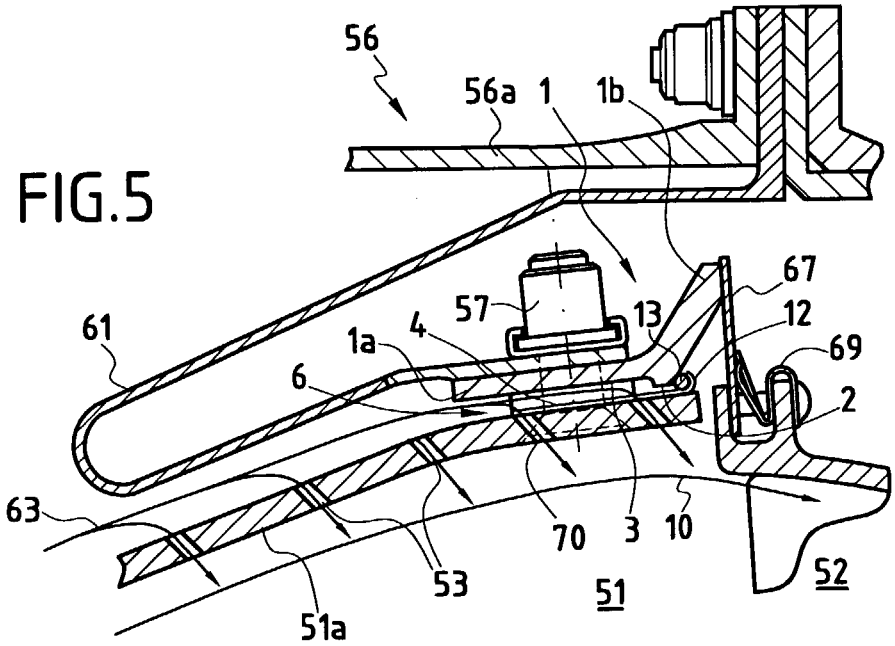
FIG. 5 is a section view of the connection portion of the outer wall of a combustion chamber with sealing downstream from the ring in an embodiment of the invention.
Figure 6:
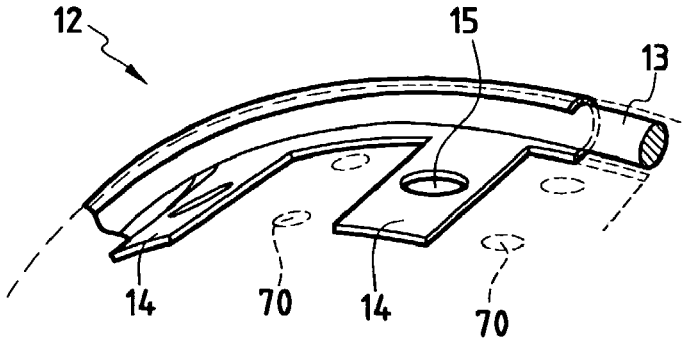
FIG. 6 is a truncated diagrammatic perspective view of an example of the piece of foil shown in FIG. 5.

In a variant, sealing between the ring and the wall of the combustion chamber may be provided downstream from the shoulder, i.e. outside the cavity. In this case, and as shown in FIG. 5, a gasket 13 such as a braid or a capillary tube is held in position against the outside surface of the ring by a holding member or foil 12. The coil 12 is fixed between the wall 51*a* of the combustion chamber and the washers 4 or the contact portions 104 by tightening the fasteners 57. As shown in FIG. 6, the foil 12 may be in the form of a single piece or in the form of a plurality of sectors 14 held adjacent to one another around the wall of the combustion chamber. The contact area between the wall of the combustion chamber and the foil 12 is reduced to the minimum needed for fixing purposes in order to avoid obstructing the perforations 70 of the combustion chamber present in said zone.

Figure 7:
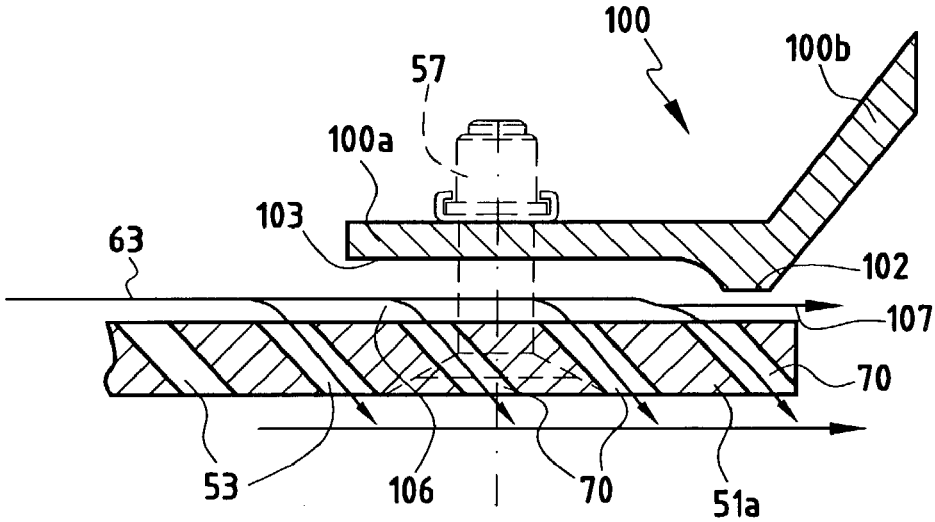
FIG. 7 is a section view away from the connection zone of a sealing ring mounted on the outer wall of a combustion chamber with a leakage flow exiting from the ring of the invention.

In another embodiment of a combustion chamber having a sealing ring of the present invention, a portion of the cooling air stream which flows in the cavity(ies) formed by the sealing ring is allowed to leak out. Thus, as shown in FIG. 7, the thickness of the contact portions 104, or of the washers 4 depending on which embodiment of the ring is being used, can be determined in such a manner as to leave a gap between the shoulder and the wall of the combustion chamber so as to allow a leakage flow. Consequently, when the above-described sealing devices are not used, a fraction of the air stream 23 constitutes a leakage flow 107 and this flow is calibrated by the shoulder of the ring.

Figure 8:
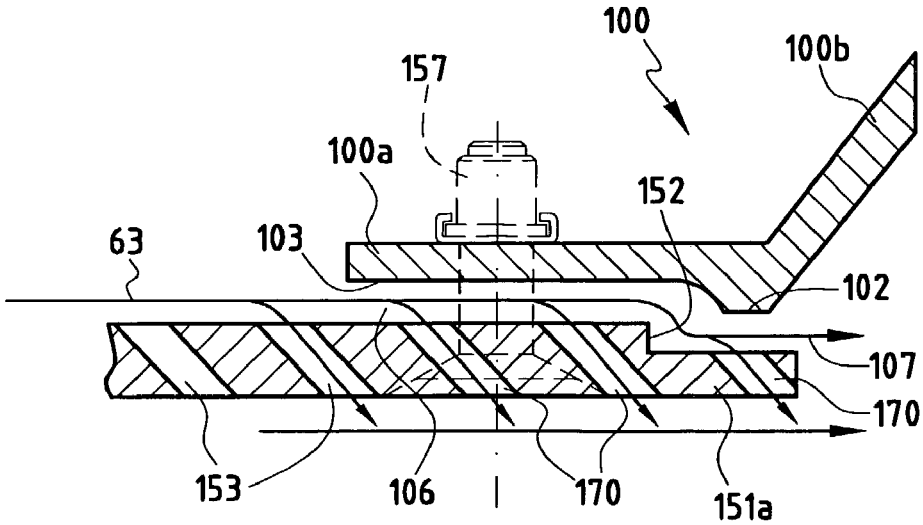
FIG. 8 is a section view outside the connection zone of a sealing ring mounted on the outer wall of a combustion chamber having a step for the leakage flow exiting from the ring of the invention.

In a particular embodiment of the combustion chamber as shown in FIG. 8, a step 152 may be formed in the end of the combustion chamber wall so as to allow a fraction of the cooling air stream 63 flowing in the cavities 106 of the sealing ring 100 to form a leakage flow 107. For this purpose, it is necessary for the step 152 to be made upstream from the shoulder 102 so as to leave a leakage passage for a fraction of the cooing air stream 63 that enters into the cavities 106. Although the combustion chamber with the step 152 can be used equally well with the sealing ring 1 or with the sealing ring 100, the second embodiment of the sealing ring 100 presents the advantage of enabling the leakage flow rate feeding the outer or inner shroud of the high pressure nozzle to be adjusted more finely because of the multiple cavities 106 that it forms together with the wall of the combustion chamber.

Assemblies including a leakage flow exiting the sealing ring as shown in FIGS. 7 and 8 can be made equally well with the sealing ring 1 or with the sealing ring 100, constituting the first and the second embodiments of the invention.

Furthermore, whichever embodiment is being used to provide a leakage flow exiting the sealing ring, the spoiler that is formed by the shoulder serves not only to force the cooling air stream to flow into the perforations, but also to co-operate with the wall to calibrate the leakage flow so as to create a cooling film for the outer shroud of the high pressure nozzle. Such calibration enables the rate at which air flows into the combustion chamber to be controlled.

FIGS. 2 to 8 show embodiments of the sealing ring of the present invention in a configuration adapted for connecting the outer wall of the combustion chamber to the high pressure shroud. Nevertheless, the person skilled in the art will have no difficulty in devising a similar ring for the end of the inner wall 51*b* of the combustion chamber. Under such circumstances, the sealing ring merely has a configuration that is the inverse of that described so that the recess(es) lie in its outer surface facing the inner wall 51*b* of the combustion chamber and so that its flange extends inwardly.

The sealing ring of the present invention can be made out of a thermostructural composite material such as carbon and silicon carbide (C/SiC) or silicon carbide and silicon carbide (SiC/SiC), or it can be made out of a metal alloy. The walls of the combustion chamber can also be made out of a thermostructural composite material such as C/SiC or SiC/SiC, or else out of an optionally porous metal material, or indeed out of a metal matrix composite material.

The cavity(ies) of the ring of the present invention enable cooling to be maximized by multiple perforations in the walls of the combustion chamber underlying the ring. Computations performed on a combustion chamber fitted with the sealing ring of the invention have shown that temperature can be reduced by about 400° C. in the connection zone.

As a consequence, the lifetime of the end of the combustion chamber is increased and a cooling film can be generated for the inner shroud of the high pressure nozzle, and possibly also for the outer shroud. The present invention thus provides a solution for cooling the walls of the combustion chamber which allows the combustion chamber to be connected directly to the casing via its walls while nevertheless providing sealing between the combustion gas stream and the bypass stream which is used to provide a stream of cooling air.

What is claimed is:

1. A ring for fixing on the end of a combustion chamber, the ring being formed by a sleeve which is fixed around the end of a wall of the combustion chamber via a plurality of orifices for receiving fasteners, wherein the sleeve has at least one recess in its face facing the wall of the combustion chamber, thereby reducing the area of the sleeve that presses against the wall of the combustion chamber, and co-operating with said wall to form an open cavity in which a stream of cooling air can flow.

2. A ring according to claim 1, including an annular shoulder defining the end of the cavity formed between the ring and the wall of the combustion chamber.

3. A ring according to claim 2, wherein the annular shoulder forms a spoiler to force the bypass air stream flowing in the cavity to flow towards the wall of the combustion chamber.

4. A ring according to claim 1, wherein the area of the sleeve pressing against the wall of the combustion chamber further includes contact portions formed around the orifices, said contact portions defining a plurality of recesses uniformly distributed over the face of the sleeve that faces the wall of the combustion chamber.

5. A ring according to claim 4, wherein the contact portions are of a thickness greater than the thickness of the annular shoulder so as to allow a fraction of the cooling air stream which flows in the cavity(ies) formed by the sealing ring to constitute a leakage flow.

6. A ring according to claim 1, the ring being made of a thermostructural composite material or of out of a metal alloy.

7. A ring according to claim 1, further comprising a flange extending the sleeve, said flange extending beyond the end of the combustion chamber.

8. A combustion chamber, including at least one ring according to claim 1, said at least one ring being fixed to the end of one of the walls of the combustion chamber by fasteners.

9. A combustion chamber according to claim 8, having a plurality of perforations in its portion covered by the ring, said perforations being fed with a stream of cooing air which flows in the cavity(ies) formed between the sealing ring and the wall of the combustion chamber.

10. A combustion chamber according to claim 8, further including a gasket between the ring and the wall of said combustion chamber.

11. A combustion chamber according to claim 10, wherein said gasket is held in the bottom of the open cavity.

12. A combustion chamber according to claim 10, wherein said gasket is placed at the end of the ring.

13. A combustion chamber according to claim 12, wherein said gasket is held at the end of the ring by an annular piece of foil held on the wall by the fasteners.

14. A combustion chamber according to claim 13, wherein said piece of foil comprises a plurality of sectors held adjacent to one another on the wall of the combustion chamber by the fasteners.

15. A combustion chamber according to claim 8, wherein each fastener comprises a washer of thickness greater than the thickness of the opening cavity formed between the wall of the combustion chamber and the ring so as to allow a fraction of the cooling air stream flowing in the cavity(ies) formed by the sealing ring to constitute a leakage flow.

16. A combustion chamber according to claim 8, including a step formed in the end of its wall so as to allow a fraction of the cooling air stream flowing in the cavity(ies) formed by the sealing ring to constitute a leakage flow.

17. A combustion chamber, including first and second rings according to claim 1, said first ring being fixed to the end of the outer wall of the combustion chamber and said second ring being fixed to the end of the inner wall of the combustion chamber.

18. A combustion chamber according to claim 8, wherein its walls are made out of a thermostructural composite material or out of a metal alloy.

19. A ring for fixing on an end of a combustion chamber, the ring being formed by a sleeve which is fixed around a wall of the combustion chamber via a plurality of orifices for receiving fasteners, wherein the sleeve has at least one recess in a surface opposing the wall of the combustion chamber, thereby reducing an area of the sleeve that abuts the opposing wall of the combustion chamber, and co-operating with said wall to form an open cavity therebetween in which a stream of cooling air can flow.

20. A method for contributing to cooling of a combustion chamber, comprising applying the ring of claim 19.

* * * * *